US009808058B1

(12) United States Patent
Jones

(10) Patent No.: US 9,808,058 B1
(45) Date of Patent: Nov. 7, 2017

(54) CONTACT LENS PACKAGE CASE

(71) Applicant: Andrew Jones, Shreveport, LA (US)

(72) Inventor: Andrew Jones, Shreveport, LA (US)

( * ) Notice: Subject to any disclaimer, the term of this patent is extended or adjusted under 35 U.S.C. 154(b) by 287 days.

(21) Appl. No.: 14/665,460

(22) Filed: Mar. 23, 2015

(51) Int. Cl.
*A45C 11/04* (2006.01)
*A45C 11/00* (2006.01)
*A45C 13/02* (2006.01)

(52) U.S. Cl.
CPC ..... *A45C 11/005* (2013.01); *A45C 13/02* (2013.01); *A45C 2011/006* (2013.01)

(58) Field of Classification Search
CPC A45C 11/005; A45C 11/046; A45C 2011/006
USPC ..... 206/5.1
See application file for complete search history.

(56) References Cited

U.S. PATENT DOCUMENTS 3,394,717 A 7/1968 Hollinger
3,782,584 A 1/1974 Swenson et al.
3,880,278 A 4/1975 Brown
4,190,191 A 2/1980 Forbes, Jr.
4,406,362 A 9/1983 Thomas et al.
4,909,382 A * 3/1990 Cuppari ..... A45C 11/005 116/308
5,101,967 A 4/1992 Sibley
5,129,999 A 7/1992 Holland et al.
5,375,698 A 12/1994 Ewart et al.
5,685,420 A 11/1997 Martin et al.
5,697,495 A 12/1997 Abrams et al.
5,722,536 A 3/1998 Pierce et al.
6,640,995 B2 11/2003 Jepson
6,779,814 B2 * 8/2004 Polick ..... B42D 1/00 206/472
7,331,449 B2 2/2008 Pinchassi Dar et al.

* cited by examiner

*Primary Examiner* — Steven A. Reynolds
*Assistant Examiner* — Javier A Pagan
(74) *Attorney, Agent, or Firm* — R. Keith Harrison

(57) ABSTRACT

A contact lens package case includes a case frame having a case frame panel with a right panel edge, a left panel edge and first and second panel surfaces extending between the right panel edge and the left panel edge; a right contact lens compartment including a right compartment end cap carried by the first panel surface at the left panel edge of the case frame panel; and a right compartment cover carried by the case frame in sliding relation thereto. The right compartment cover is positional between a closed position engaging the right compartment end cap and an open position disengaging the right compartment end cap. A left contact lens compartment includes a left compartment end cap carried by the second panel surface at the right panel edge of the case frame panel and a left compartment cover carried by the case frame in sliding relation thereto. The left compartment cover is positional between a closed position engaging the left compartment end cap and an open position disengaging the left compartment end cap.

18 Claims, 8 Drawing Sheets

CONTACT LENS PACKAGE CASE

FIELD

Illustrative embodiments of the disclosure generally relate to receptacles for the storage of contact lens packages. More particularly, illustrative embodiments of the disclosure relate to a contact lens package case which separately organizes, stores and protects packages containing contact lenses for the left and right eyes of a user and facilitates easy access to the contact lens packages.

SUMMARY

Illustrative embodiments of the disclosure are generally directed to a contact lens package case. An illustrative embodiment of the contact lens package case includes a case frame having a case frame panel with a right panel edge, a left panel edge and first and second panel surfaces extending between the right panel edge and the left panel edge; a right contact lens compartment including a right compartment end cap carried by the first panel surface at the left panel edge of the case frame panel; and a right compartment cover carried by the case frame in sliding relation thereto. The right compartment cover is positional between a closed position engaging the right compartment end cap and an open position disengaging the right compartment end cap. A left contact lens compartment includes a left compartment end cap carried by the second panel surface at the right panel edge of the case frame panel and a left compartment cover carried by the case frame in sliding relation thereto. The left compartment cover is positional between a closed position engaging the left compartment end cap and an open position disengaging the left compartment end cap.

BRIEF DESCRIPTION OF THE DRAWINGS

Illustrative embodiments of the disclosure will now be described, by way of example, with reference to the accompanying drawings, wherein.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "front" and "rear" are used in aid in an understanding of the illustrative embodiments of the contact lens package case and are not intended to be construed in a limiting sense.

Figure 3:
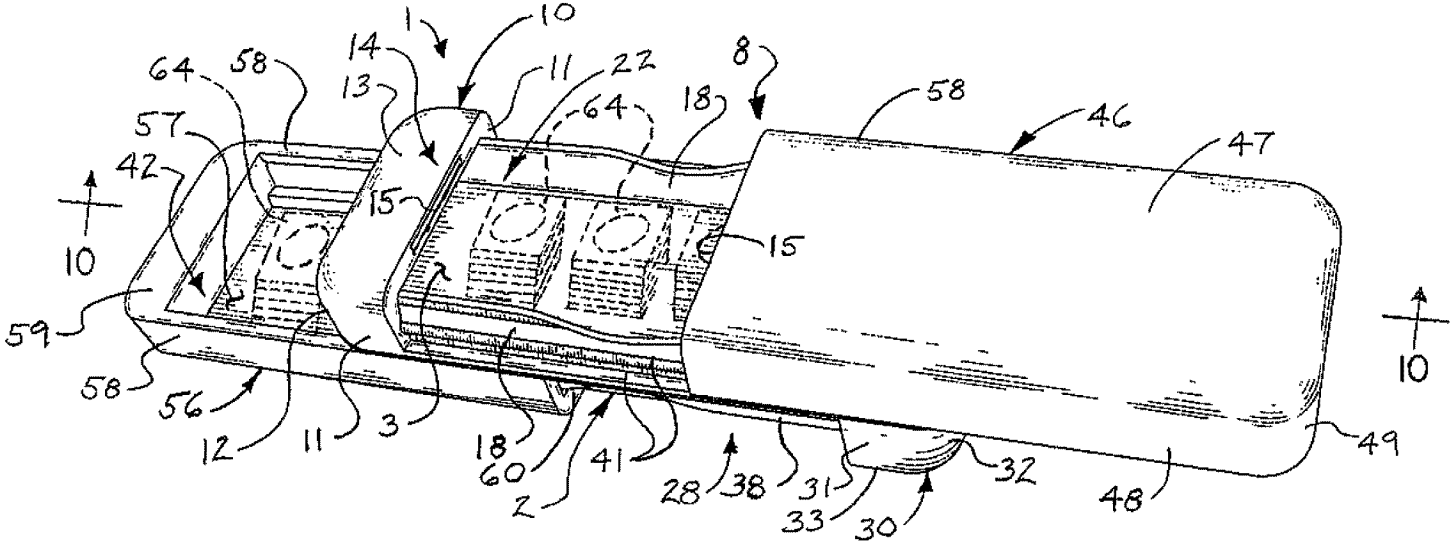
FIG. 3 is a perspective view of an illustrative embodiment of the contact lens package case, with a right contact lens compartment and a left contact lens compartment shown in partially opened positions and multiple contact lens packages (illustrated in phantom) in the right and left contact lens compartments.
Figure 4:
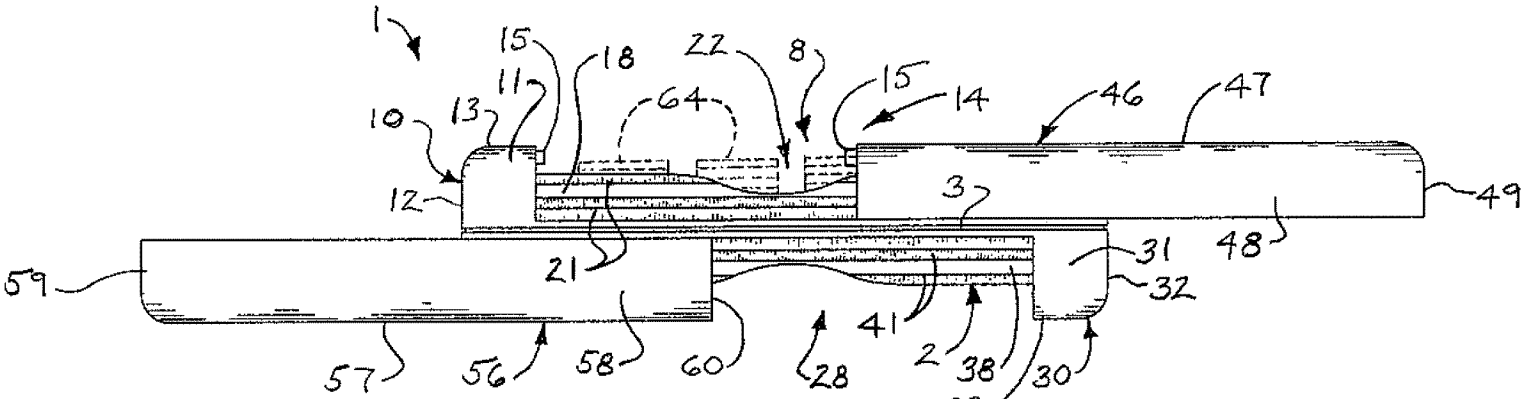
FIG. 4 is a side view of the partially opened contact lens package case illustrated in FIG. 3.
Figure 5:
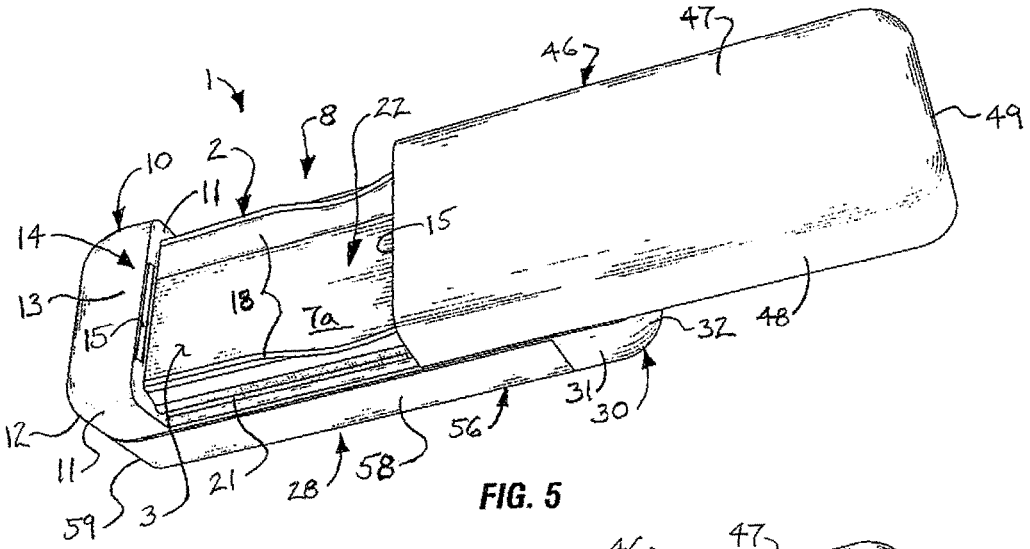
FIG. 5 is a perspective view of an illustrative embodiment of the contact lens package case, with the right contact lens compartment partially opened and the left contact lens compartment closed.

Referring to the drawings, an illustrative embodiment of the contact lens package case is generally illustrated by reference numeral 1. As illustrated in FIGS. 3 and 4 and will be hereinafter further described, the contact lens package case 1 is suitable for containing multiple contact lens packages 64 (illustrated in phantom) in which are packaged contact lenses corresponding to the right eye and the left eye of a user (not illustrated). In some applications, the contact lenses which are packaged in the contact lens packages 64 may include daily contact lenses which are replaced by the user on a daily basis. The contact lens package case 1 organizes, stores and protects the contact lens packages 64 from damage. The contact lens package case 1 keeps the contact lens packages 64 for the right eye separate from the contact lens packages 64 for the left eye since the contact lens prescriptions for the right and left eyes may be different for the user. The contact lens package case 1 allows the user to easily access a contact lens package 64 for the right eye or the left eye when a contact lens for that eye is needed. Accordingly, the contact lens package case 1 includes a right contact lens compartment 8 and a left contact lens compartment 28 which can be selectively and independently opened to separately access the contact lens packages 64 containing the contact lenses for the right eye and the left eye, respectively, of the user. The right contact lens compartment 8 and the left contact lens compartment 28 may be mirror images and may be rotated 180 degrees and inverted relative to each other, as will be hereinafter further described. The contact lens package case 1 may be fabricated of metal, plastic and/or other materials using molding, casting, machining and/or other fabrication techniques known by those skilled in the art.

The contact lens package case 1 may include a case frame 2. As particularly illustrated in FIGS. 13 and 14, the case frame 2 may include a case frame panel 3 which may be generally flat or planar, elongated and rectangular in shape. The case frame panel 3 may have a first panel surface 7*a* and a second panel surface 7*b* which is opposite the first panel surface 7*a*. The case frame panel 3 may have a right panel edge 4 and a left panel edge 5. The right panel edge 4 and the left panel edge 5 may be generally parallel and spaced-apart to each other. A pair of panel side edges 6 may extend between the right panel edge 4 and the left panel edge 5. The panel side edges 6 may be generally parallel and spaced-apart to each other and generally perpendicular to the right panel edge 4 and the left panel edge 5.

Figure 13:
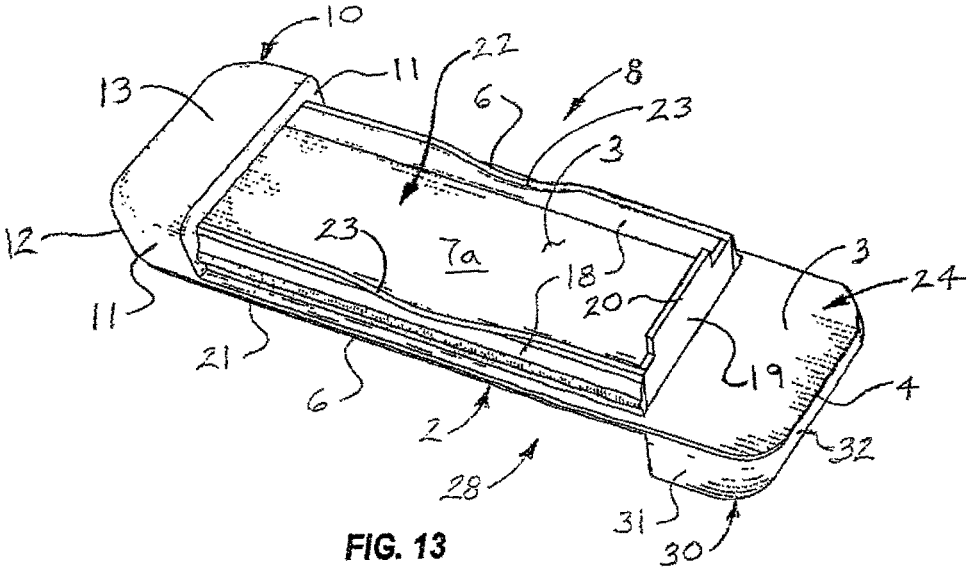
FIG. 13 is a top perspective view of a typical case frame component of the contact lens package case, with the right compartment cover and the left compartment cover removed from the case frame.

As illustrated in FIG. 13, the right contact lens compartment 8 may include a right compartment end cap 10 on the first panel surface 7*a* at the left panel edge 5 of the case frame panel 3. The right compartment end cap 10 may have a pair of spaced-apart right compartment end cap side walls 11 which extend from the first panel surface 7*a* at the respective panel side edges 6 of the case frame panel 3. A right compartment end cap rear wall 12 may extend from the first panel surface 7*a* at the left panel edge 5 of the case frame panel 3 and between the right compartment end cap side walls 11. A right compartment end cap main wall 13 may extend between the right compartment end cap side walls 11 and from the right compartment end cap rear wall 12 over the first panel surface 7*a* of the case frame panel 3.

A pair of generally elongated, parallel, spaced-apart right compartment side walls 18 may extend from the respective right compartment end cap side walls 11 of the right compartment end cap 10 along the first panel surface 7*a* and adjacent and parallel to the respective panel side edges 6 toward the right panel edge 4 of the case frame panel 3. At least one wall rail 21 may be provided along an exterior surface of each corresponding right compartment side wall 18 for purposes which will be hereinafter described. In some embodiments, a pair of access notches 23 may be provided in the respective right compartment side walls 18. A right compartment end wall 19 may extend from the first panel surface 7*a* between the extending or distal ends of the right compartment side walls 18. A right compartment cover stop 20 may protrude from the edge of the right compartment end wall 19 for purposes which will be hereinafter described. A right compartment interior 22 may be formed within the right compartment end cap 10 and by and between the first panel surface 7*a* and the right compartment side walls 18 and the right compartment end wall 19. A right cover space 24 may be formed between the right compartment end wall 19 and the right panel edge 4 of the case frame panel 3 for purposes which will be hereinafter described.

Figure 14:
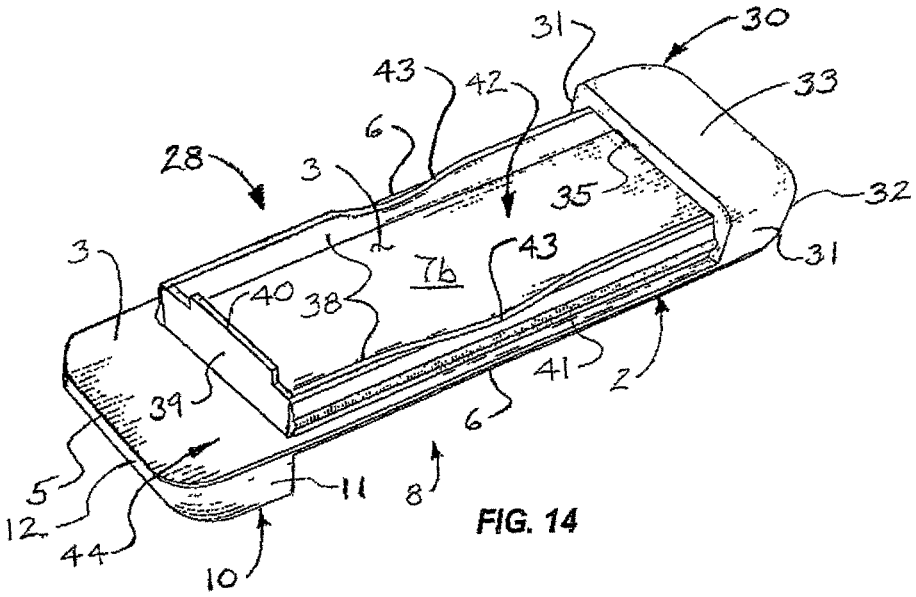
FIG. 14 is a bottom perspective view of the case frame with the right and left compartment covers removed.

As illustrated in FIG. 14, the left contact lens compartment 28 may include a left compartment end cap 30 on the second panel surface 7*b* at the right panel edge 4 of the case frame panel 3. The left compartment end cap 30 may include a pair of spaced-apart left compartment end cap side walls 31 which extend from the second panel surface 7*b* at the respective panel side edges 6 of the case frame panel 3. A left compartment end cap rear wall 32 may extend from the right panel edge 4 between the left compartment end cap side walls 31. A left compartment end cap main wall 33 may extend between the left compartment end cap side walls 31 and from the left compartment end cap rear wall 32 over the second panel surface 7*b* of the case frame panel 3.

A pair of generally elongated, parallel, spaced-apart left compartment side walls 38 may extend from the respective left compartment end cap side walls 31 of the left compartment end cap 30 along the second panel surface 7*b* and adjacent and parallel to the respective panel side edges 6 toward the left panel edge 5 of the case frame panel 3. At least one wall rail 41 may be provided along an exterior surface of each corresponding left compartment side wall 38 for purposes which will be hereinafter described. In some embodiments, a pair of access notches 43 may be provided in the respective left compartment side walls 38. A left compartment end wall 39 may extend from the second panel surface 7*b* between the extending or distal ends of the left compartment side walls 38. A left compartment cover stop 40 may protrude from the edge of the left compartment end wall 39 for purposes which will be hereinafter described. A left compartment interior 42 may be formed within the left compartment end cap 30 and by and between the second panel surface 7*b* and the left compartment side walls 38 and the left compartment end wall 39. A left cover space 44 may be formed between the left compartment end wall 39 and the left panel edge 5 of the case frame panel 3 for purposes which will be hereinafter described.

Figure 9:
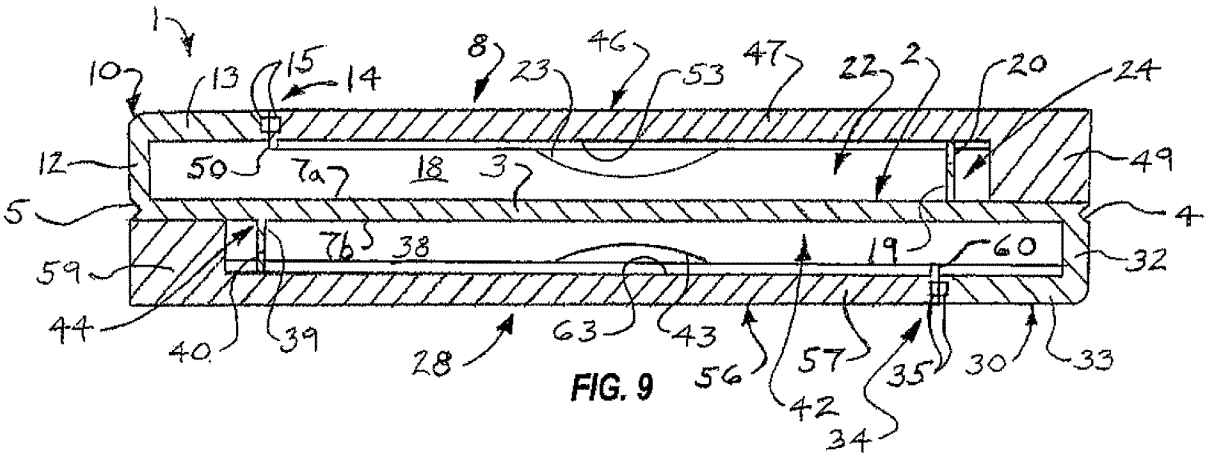
FIG. 9 is a longitudinal sectional view, taken along section lines 9-9 in FIG. 1.
Figure 10:
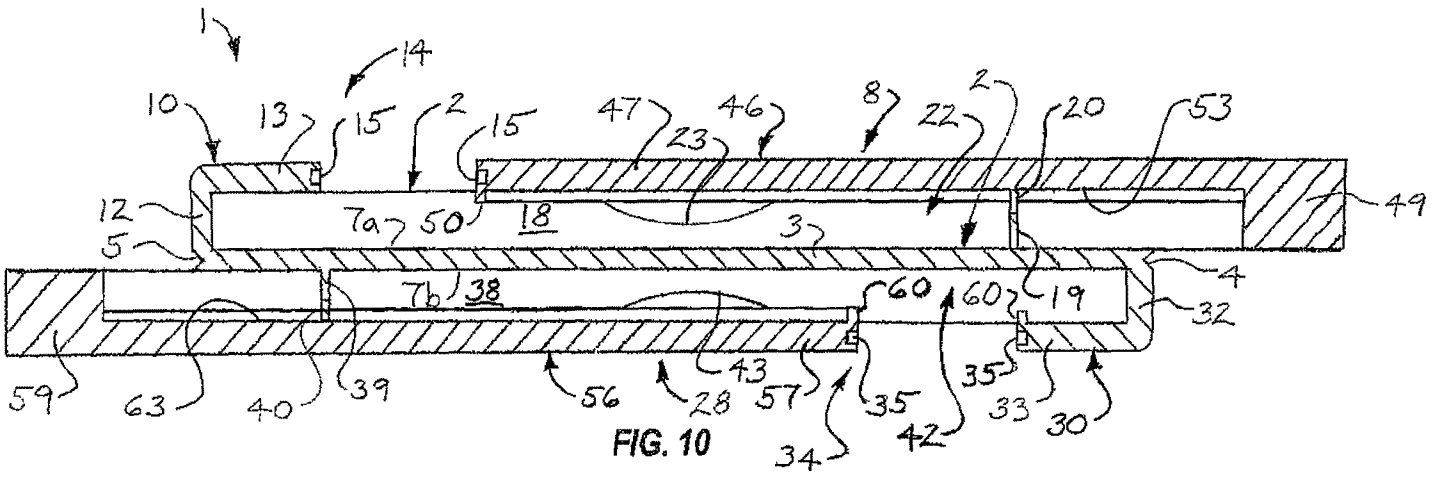
FIG. 10 is a longitudinal sectional view, taken along section lines 10-10 in FIG. 3.
Figure 11:
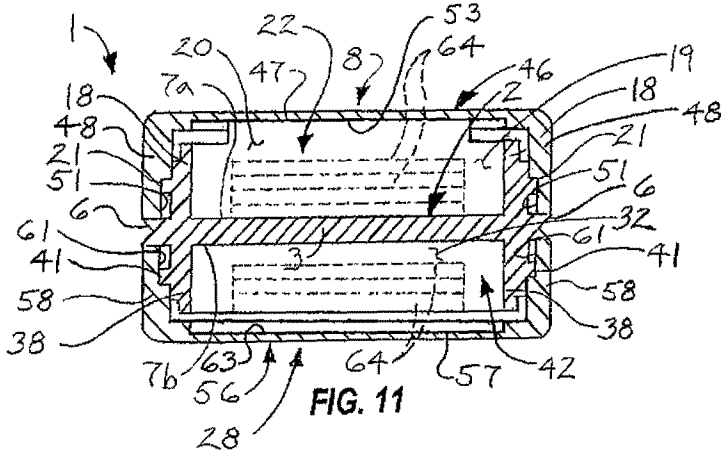
FIG. 11 is a transverse sectional view, taken along section lines 11-11 in FIG. 2.
Figure 12:
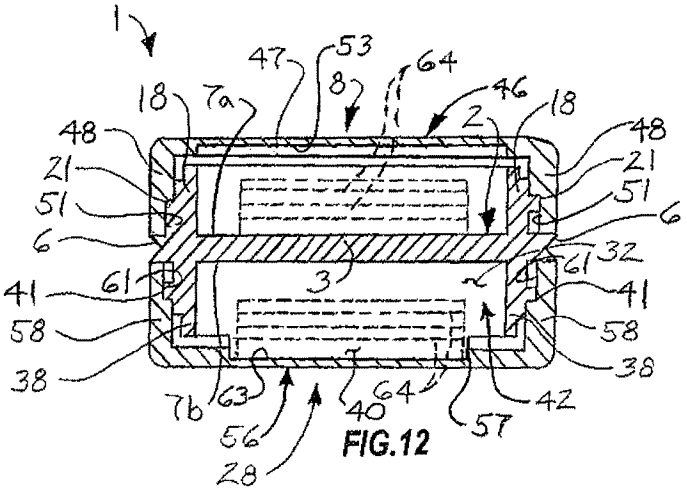
FIG. 12 is a transverse sectional view, taken along section lines 12-12 in FIG. 2.
Figure 15:
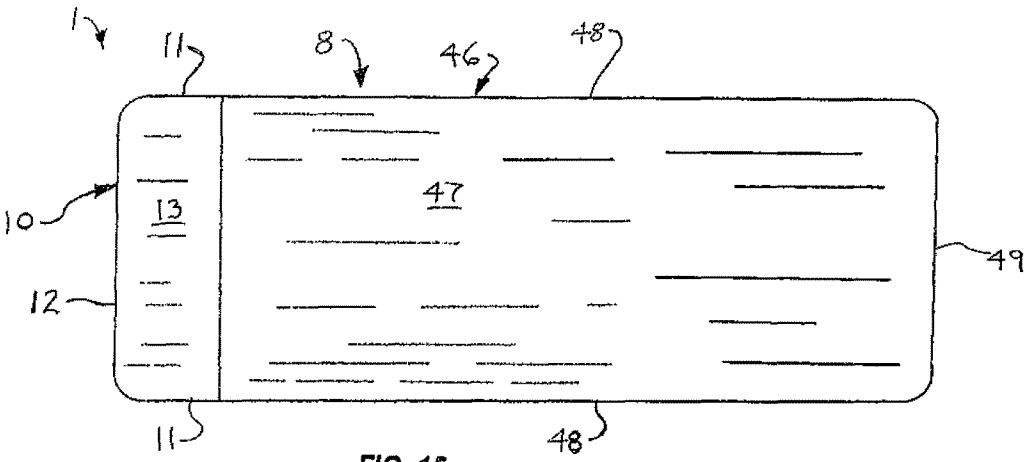
FIG. 15 is a top view of an illustrative embodiment of the contact lens package case.
Figure 16:
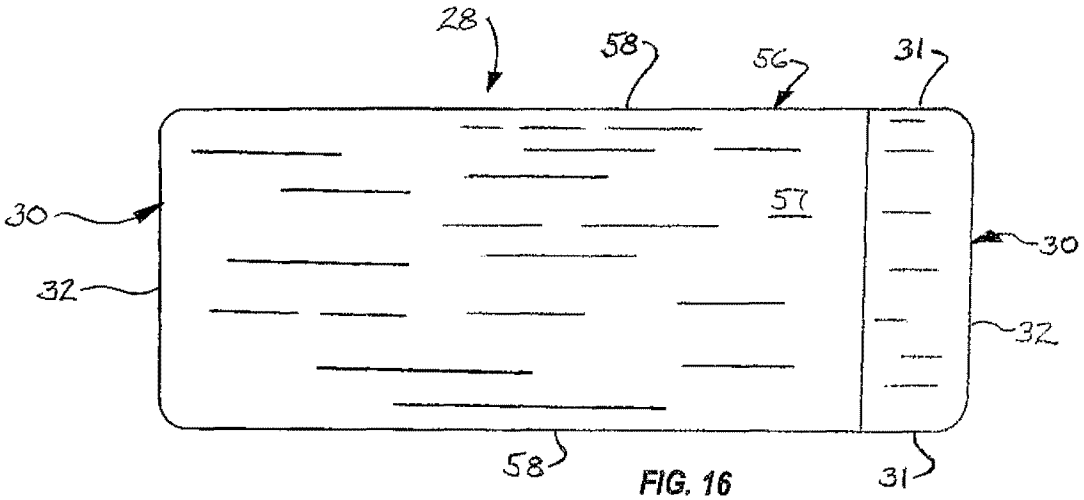
FIG. 16 is a bottom view of an illustrative embodiment of the contact lens package case.

As particularly illustrated in FIGS. 3 and 4, the right contact lens compartment 8 may include a right compartment cover 46 which slidably engages the right compartment side walls 18 of the case frame 2 to facilitate selective opening and closing of the right compartment interior 22. The right compartment cover 46 may include a cover main wall 47 which may be generally elongated and rectangular in shape. As illustrated in FIGS. 9-12, a right cover depression 53 may be provided in an interior surface of the cover main wall 47 of the right compartment cover 46. A pair of spaced-apart cover side walls 48 may extend from opposite side edges of the cover main wall 47. As illustrated in FIGS. 11 and 12, at least one rail groove 51 may be provided in the interior surface of each cover side wall 48. A cover end wall 49 may extend from an outside edge of the cover main wall 47 between the cover side walls 48. As illustrated in FIGS. 9 and 10, in some embodiments, a cover stop flange 50 may extend from an inside edge of the cover main wall 47 opposite the cover end wall 49. Accordingly, as illustrated in FIGS. 3, 4 and 10, the rail grooves 51 (FIGS. 11 and 12) in the interior surfaces of the cover side walls 48 on the right compartment cover 46 slidably engage the companion wall rails 21 on the exterior surfaces of the respective right compartment side walls 18 to facilitate selective opening and closing of the right compartment interior 22 in the right contact lens compartment 8. As illustrated in FIG. 15, a label (not illustrated) which includes the designation "RIGHT" may be included on or stamped or molded into the right compartment cover 46 to indicate the right contact lens compartment 8. As illustrated in FIG. 9, when the right compartment cover 46 is in the closed position, the right cover space 24 may accommodate the cover end wall 49 of the right compartment cover 46 such that the cover end wall 49 is generally flush with the right panel edge 4 of the case frame panel 3.

The left contact lens compartment 28 may include a left compartment cover 56 which slidably engages the left compartment side walls 38 of the case frame 2 to facilitate selective opening and closing of the left compartment interior 42. The left compartment cover 56 may include a cover main wall 57 which may be generally elongated and rectangular in shape. As illustrated in FIGS. 9-12, a left cover depression 63 may be provided in an interior surface of the cover main wall 57 of the left compartment cover 56. A pair of spaced-apart cover side walls 58 may extend from opposite side edges of the cover main wall 57. As illustrated in FIGS. 11 and 12, at least one rail groove 61 may be provided in the interior surface of each cover side wall 58. A cover end wall 59 may extend from an outside edge of the cover main wall 57 between the cover side walls 58. As illustrated in FIGS. 9 and 10, in some embodiments, a cover stop flange 60 may extend from an inside edge of the cover main wall 57 opposite the cover end wall 59. Accordingly, as illustrated in FIGS. 3, 4 and 10, the rail grooves 61 in the interior surfaces of the cover side walls 58 on the left compartment cover 56 slidably engage the companion wall rails 41 on the exterior surfaces of the respective left compartment side walls 38 to facilitate selective opening and closing of the left compartment interior 42 in the left contact lens compartment 28. As illustrated in FIG. 15, a label (not illustrated) which includes the designation "LEFT" may be included on or stamped or molded into the left compartment cover 56 to indicate the left contact lens compartment 28. As illustrated in FIG. 9, when the left compartment cover 56 is in the closed position, the left cover space 44 may accommodate the cover end wall 59 of the left compartment cover 56 such that the cover end wall 59 is generally flush with the left panel edge 5 of the case frame panel 3.

As further illustrated in FIGS. 9 and 10, in some embodiments, a right cover securing mechanism 14 may include at least one pair of right cover magnets 15 provided along the inside edge of the cover main wall 47 on the right compartment cover 46 and on the inside edge of the right compartment end cap main wall 13 of the right compartment end cap 10, respectively. Similarly, a left cover securing mechanism 34 may include at least one pair of left cover magnets 35 provided on the inside edge of the cover main wall 57 on the left compartment cover 56 and on the inside edge of the left compartment end cap main wall 33 on the left compartment end cap 30, respectively. Accordingly, the right compartment cover 46 of the right contact lens compartment 8 may be secured in the closed position by magnetic engagement of the right cover magnets 15 to each other. Likewise, the left compartment cover 56 of the left contact lens compartment 28 can be secured in the closed position by magnetic engagement of the left cover magnets 35 to each other. Opening of the right contact lens compartment 8 may be accomplished by orienting the contact lens packaging case 1 such that the right compartment cover 46 faces upwardly, breaking the magnetic engagement between the right cover magnets 15 and sliding the right compartment cover 46 to the right on the right compartment side walls 18 of the case frame 2. Opening of the left contact lens compartment 28 can likewise be accomplished by orienting the contact lens packaging case 1 such that the left compartment cover 56 faces upwardly, breaking the magnetic attraction between the left cover magnets 35 and sliding the left compartment cover 56 to the left on the left compartment side walls 38 of the case frame 2. The cover stop flange 50 (FIGS. 9 and 10) on the cover main wall 47 of the right compartment cover 46 may engage the right compartment cover stop 20 on the right compartment end wall 19 to prevent the right compartment cover 46 from inadvertently sliding and falling from the case frame 2 upon opening of the right contact lens compartment 8. Likewise, the cover stop flange 60 on the cover main wall 57 of the left compartment cover 56 may engage the left compartment cover stop 40 on the left compartment end wall 39 to prevent the left compartment cover 56 from inadvertently sliding and falling from the case frame 2 upon opening of the left contact lens compartment 28. In some embodiments, the right cover securing mechanism 14 and the left cover securing mechanism 34 may include earth magnets. In other embodiments, the right cover securing mechanism 14 and the left cover securing mechanism 34 may include alternative securing mechanisms known by those skilled in the art such as clamps or brackets, for example and without limitation.

Figure 1:
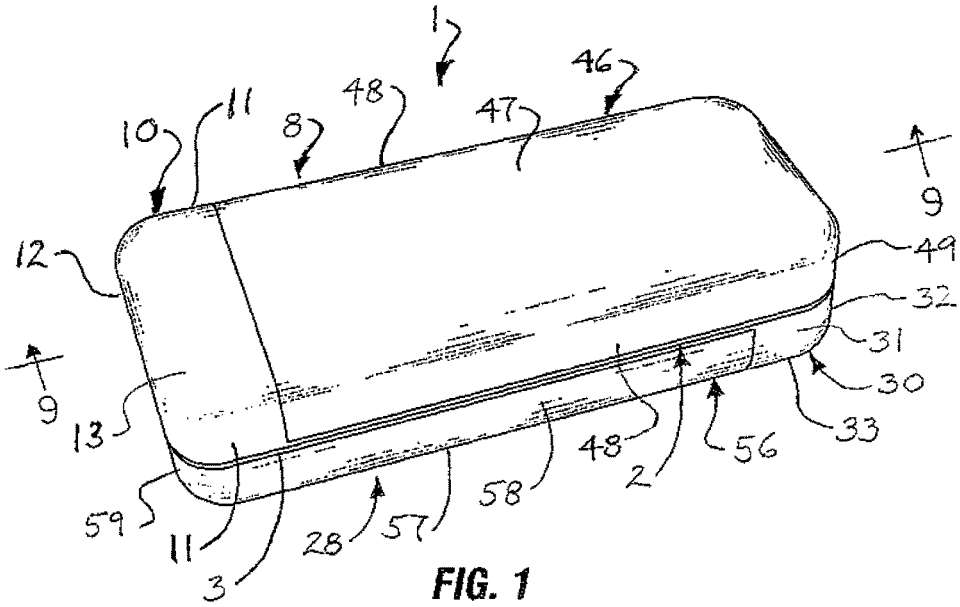
FIG. 1 is a perspective view of an illustrative embodiment of the contact lens package case.
Figure 2:
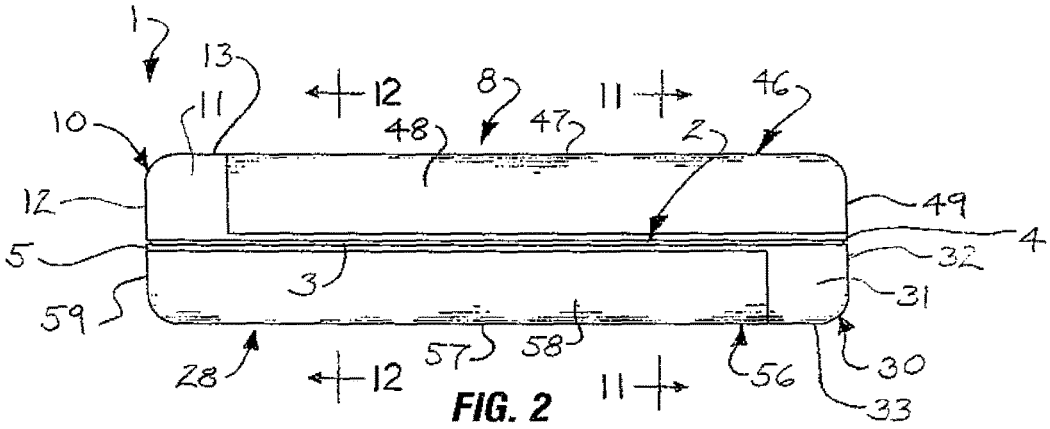
FIG. 2 is a front view of an illustrative embodiment of the contact lens package case.

In typical application of the contact lens case 1, contact lens packages 64 (illustrated in phantom in FIG. 3) which contain contact lenses for the right eye of a user may be stored in the right contact lens compartment 8. Accordingly, the right contact lens compartment 8 may be opened by initially orienting the contact lens package case 1 such that the right contact lens compartment 8 faces upwardly and the right compartment cover 46 is to the right of the right compartment end cap 10, as illustrated in FIG. 1. The right compartment cover 46 is slid to the right on the right compartment side walls 18 of the case frame 2, away from the right compartment end cap 10 from the closed position illustrated in FIGS. 1, 2 and 9 to the open position illustrated in FIGS. 3, 4 and 10. Multiple contact lens packages 64, each of which contains at least one contact lens (not illustrated) for the user's right eye, may be placed in the right compartment interior 22 of the right contact lens compartment 8. The right contact lens compartment 8 may then be closed by sliding the right compartment cover 46 to the left on the case frame 2 toward the right compartment end cap 10 until the right cover magnet 15 on the right compartment cover 46 magnetically engages the companion right cover magnet 15 on the right compartment end cap 10.

Figure 6:
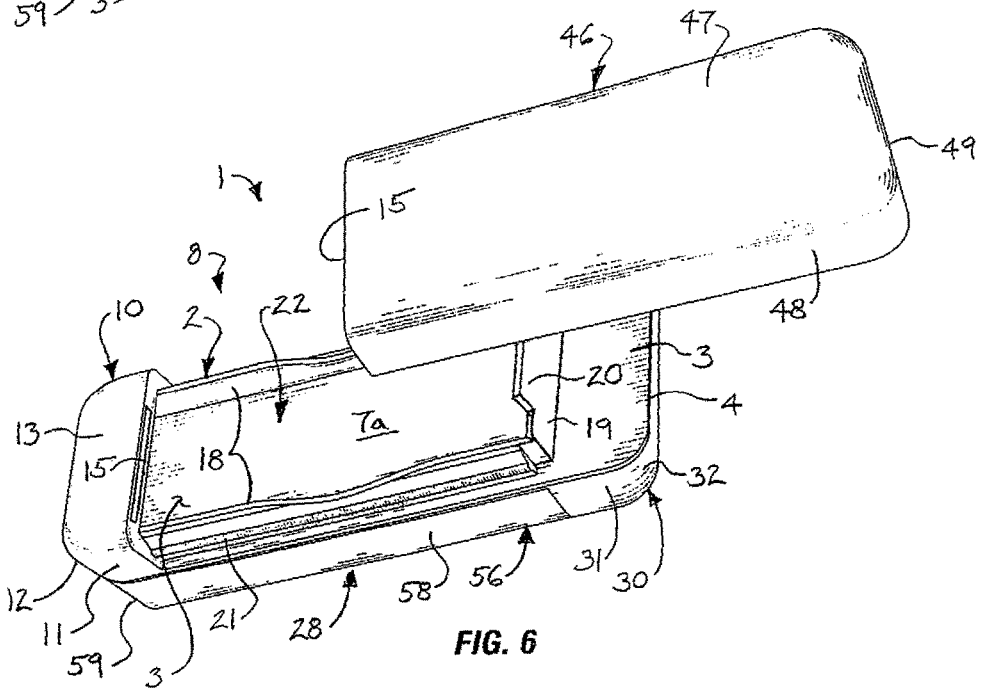
FIG. 6 is an exploded perspective view of an illustrative embodiment of the contact lens package case, with a right compartment cover removed to expose the right contact lens compartment.
Figure 7:
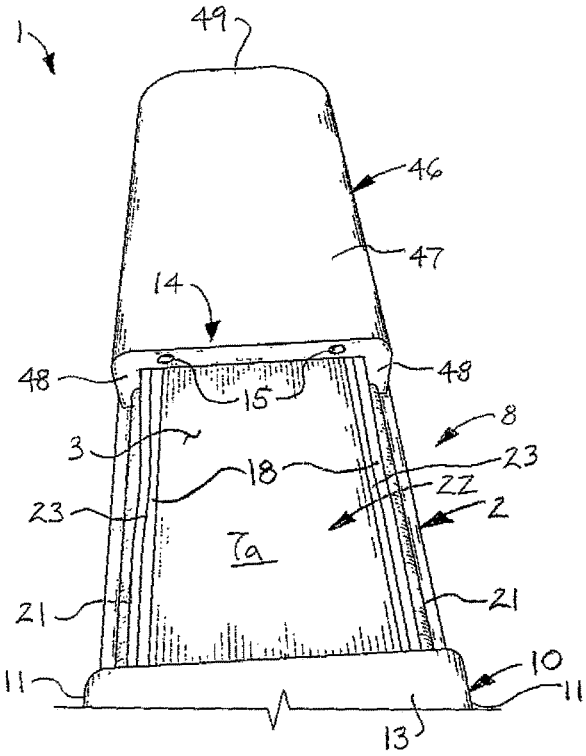
FIG. 7 is a top perspective view, partially in section, of an illustrative embodiment of the contact lens package case with the right compartment cover partially opened to expose the right contact lens compartment.
Figure 8:
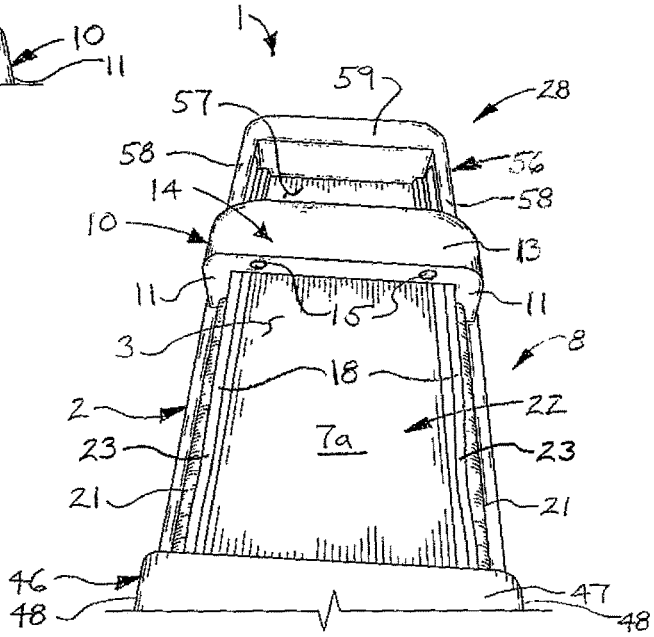
FIG. 8 is a perspective view, partially in section, of the contact lens package case with both the right compartment cover and the left compartment cover partially opened.

Contact lens packages 64 (FIG. 3) which contain contact lenses for the left eye of the user may be stored in the left contact lens compartment 28. Accordingly, the left contact lens compartment 28 may be opened by initially orienting the contact lens package case 1 such that the left contact lens compartment 28 faces upwardly and the left compartment cover 56 is to the left of the left compartment end cap 30. The left compartment cover 56 is slid to the left on the left compartment side walls 38 of the case frame 2, away from the left compartment end cap 30 from the closed position illustrated in FIGS. 1, 2 and 9 to the open position illustrated in FIGS. 3, 4 and 10. Multiple contact lens packages 64, each of which contains at least one contact lens for the user's left eye, may be placed in the left compartment cover 56, as illustrated in FIG. 3. The left contact lens compartment 28 may then be closed by sliding the left compartment cover 56 to the right toward the left compartment end cap 30 until the cover magnets 35 magnetically engage each other. As illustrated in FIG. 6, the right compartment cover 46 can be selectively removed from the case frame 2 by sliding the right compartment cover 46 to the right on the right compartment side walls 18 until the cover stop flange 50 (FIG. 9) engages the right compartment right compartment cover stop 20 and lifting the right compartment cover 46 from the case frame 2. The left compartment cover 56 can be selectively removed from the case frame 2 in like manner.

The contact lens case 1 can be easily transported by the user and selectively opened to access the contact lens packages 64 for the user's right eye, contained in the right contact lens compartment 8, or to access the contact lens packages 64 for the user's left eye, contained in the left contact lens compartment 28. Accordingly, the contact lens packages 64 in the right contact lens compartment 8 may be accessed by initially positioning the contact lens case 1 such that the right contact lens compartment 8 faces upwardly. The right compartment cover 46 is slid to the right on the right compartment side walls 18 of the case frame 2 to break the magnetic attraction between the right cover magnets 15 and expose the right compartment interior 22 and facilitate access of the contact lens packages 64. The contact lens packages 64 for the user's left eye can be obtained from the left contact lens compartment 28 in like manner. In some embodiments, the access notches 23 in the respective right compartment side walls 18 and the access notches 43 in the respective left compartment side walls 38 may facilitate removal of the contact lens packages 64 from the right contact lens compartment 8 and the left contact lens compartment 28, respectively.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A contact lens package case, comprising:

a case frame including a case frame panel having a right panel edge, a left panel edge and opposite first and second panel surfaces extending between the right panel edge and the left panel edge;

a right contact lens compartment including:

a right compartment end cap carried by the first panel surface at the left panel edge of the case frame panel; and an elongated right compartment cover carried by the case frame in sliding relation thereto, the right compartment cover positional between a closed position engaging the right compartment end cap and an open position disengaging the right compartment end cap, the right compartment cover disposed in covering, spaced-apart and substantially parallel relationship to the first panel surface of the case frame in the closed position of the right compartment cover;

a left contact lens compartment including:

a left compartment end cap carried by the second panel surface at the right panel edge of the case frame panel; and an elongated left compartment cover carried by the case frame in sliding relation thereto, the left compartment cover positional between a closed position engaging the left compartment end cap and an open position disengaging the left compartment end cap, the left compartment cover disposed in covering, spaced-apart and substantially parallel relationship to the second panel surface of the case frame in the closed position of the left compartment cover.

2. The contact lens package case of claim 1 further comprising a pair of spaced-apart right compartment side rails carried by the first panel surface of the case frame panel and extending from the right compartment end cap, and wherein the right compartment cover engages the right compartment side rails in sliding relation thereto.

3. The contact lens package case of claim 2 further comprising a right compartment end wall carried by the first panel surface of the case frame panel and extending between the right compartment side rails.

4. The contact lens package case of claim 2 further comprising a pair of spaced-apart left compartment side rails carried by the second panel surface of the case frame panel and extending from the left compartment end cap, and wherein the left compartment cover engages the left compartment side rails in sliding relation thereto.

5. The contact lens package case of claim 4 further comprising a left compartment end wall carried by the second panel surface of the case frame panel and extending between the left compartment side rails.

6. The contact lens package case of claim 1 further comprising a right cover securing mechanism carried by the right compartment end cap and the right compartment cover and a left cover securing mechanism carried by the left compartment end cap and the left compartment cover, and wherein the right cover securing mechanism secures the right compartment cover in the closed position and the left cover securing mechanism secures the left compartment cover in the closed position.

7. The contact lens package case of claim 6 wherein the right cover securing mechanism comprises a pair of right cover magnets and the left cover securing mechanism comprises a pair of left cover magnets.

8. A contact lens package case, comprising:

a case frame including a case frame panel having a right panel edge, a left panel edge and first and second panel surfaces extending between the right panel edge and the left panel edge;

a right contact lens compartment including:

a right compartment end cap carried by the first panel surface at the left panel edge of the case frame panel; and a right compartment cover carried by the case frame in sliding relation thereto, the right compartment cover positional between a closed position engaging the right compartment end cap and an open position disengaging the right compartment end cap;

a left contact lens compartment including:

a left compartment end cap carried by the second panel surface at the right panel edge of the case frame panel; and a left compartment cover carried by the case frame in sliding relation thereto, the left compartment cover positional between a closed position engaging the left compartment end cap and an open position disengaging the left compartment end cap; and wherein the right compartment end cap comprises a pair of spaced-apart right compartment end cap side walls extending from the first panel surface at respective panel side edges of the case frame panel, a right compartment end cap rear wall extending from the first panel surface at the left panel edge of the case frame panel and between the right compartment end cap side walls and a right compartment end cap main wall extending between the right compartment end cap side walls over the first panel surface of the case frame panel, and the left compartment end cap comprises a pair of spaced-apart left compartment end cap side walls extending from the second panel surface at respective panel side edges of the case frame panel, a left compartment end cap rear wall extending from the second panel surface at the right panel edge of the case frame panel and between the left compartment end cap side walls and a left compartment end cap main wall extending between the left compartment end cap side walls over the second panel surface of the case frame panel.

9. A contact lens package case, comprising:

a case frame including a generally elongated, rectangular case frame panel having a right panel edge, a left panel edge, a pair of parallel and spaced-apart panel side edges extending between the right panel edge and the left panel edge and first and second panel surfaces extending between the right panel edge and the left panel edge and between the panel side edges;

a right contact lens compartment including:

a right compartment end cap carried by the first panel surface at the left panel edge of the case frame panel; and a right compartment cover carried by the case frame in sliding relation thereto, the right compartment cover positional between a closed position engaging the right compartment end cap and an open position disengaging the right compartment end cap; and a left contact lens compartment including:

a left compartment end cap carried by the second panel surface at the right panel edge of the case frame panel; and a left compartment cover carried by the case frame in sliding relation thereto, the left compartment cover positional between a closed position engaging the left compartment end cap and an open position disengaging the left compartment end cap; and wherein the right compartment end cap comprises a pair of spaced-apart right compartment end cap side walls extending from the first panel surface at the panel side edges, respectively, of the case frame panel, a right compartment end cap rear wall extending from the first panel surface at the left panel edge of the case frame panel and between the right compartment end cap side walls and a right compartment end cap main wall extending between the right compartment end cap side walls over the first panel surface of the case frame panel, and the left compartment end cap comprises a pair of spaced-apart left compartment end cap side walls extending from the second panel surface at the panel side edges, respectively, of the case frame panel, a left compartment end cap rear wall extending from the second panel surface at the right panel edge of the case frame panel and between the left compartment end cap side walls and a left compartment end cap main wall extending between the left compartment end cap side walls over the second panel surface of the case frame panel.

10. The contact lens package case of claim 9 further comprising a pair of spaced-apart right compartment side rails carried by the first panel surface of the case frame panel and extending from the right compartment end cap, and wherein the right compartment cover engages the right compartment side rails in sliding relation thereto.

11. The contact lens package case of claim 10 further comprising a right compartment end wall carried by the first panel surface of the case frame panel and extending between the right compartment side rails.

12. The contact lens package case of claim 10 further comprising a pair of spaced-apart left compartment side rails carried by the second panel surface of the case frame panel and extending from the left compartment end cap, and wherein the left compartment cover engages the left compartment side rails in sliding relation thereto.

13. The contact lens package case of claim 12 further comprising a left compartment end wall carried by the second panel surface of the case frame panel and extending between the left compartment side rails.

14. The contact lens package case of claim 9 further comprising a right cover securing mechanism carried by the right compartment end cap and the right compartment cover and a left cover securing mechanism carried by the left compartment end cap and the left compartment cover, and wherein the right cover securing mechanism secures the right compartment cover in the closed position and the left cover securing mechanism secures the left compartment cover in the closed position.

15. The contact lens package case of claim 14 wherein the right cover securing mechanism comprises a pair of right cover magnets and the left cover securing mechanism comprises a pair of left cover magnets.

16. A contact lens package case, comprising:

a case frame including a generally elongated, rectangular case frame panel having a right panel edge, a left panel edge, a pair of parallel and spaced-apart panel side edges extending between the right panel edge and the left panel edge and first and second panel surfaces extending between the right panel edge and the left panel edge and between the panel side edges;

a right contact lens compartment including:

a right compartment end cap carried by the first panel surface at the left panel edge of the case frame panel;

a pair of generally elongated, parallel, spaced-apart right compartment side walls carried by the first panel surface and extending from the right compartment end cap toward the left panel edge of the case frame panel;

a right compartment end wall carried by the first panel surface and extending between the right compartment side walls; and a right compartment cover carried by the right compartment side walls of the case frame in sliding relation thereto, the right compartment cover positional between a closed position engaging the right compartment end cap and an open position disengaging the right compartment end cap; and a left contact lens compartment including:

a left compartment end cap carried by the second panel surface at the right panel edge of the case frame panel;

a pair of generally elongated, parallel, spaced-apart left compartment side walls carried by the second panel surface and extending from the left compartment end cap toward the right panel edge of the case frame panel;

a left compartment end wall carried by the second panel surface and extending between the left compartment side walls; and a left compartment cover carried by the left compartment side walls of the case frame in sliding relation thereto, the left compartment cover positional between a closed position engaging the left compartment end cap and an open position disengaging the left compartment end cap; and wherein the right compartment end cap comprises a pair of spaced-apart right compartment end cap side walls extending from the first panel surface at the panel side edges, respectively, of the case frame panel, a right compartment end cap rear wall extending from the first panel surface at the left panel edge of the case frame panel and between the right compartment end cap side walls and a right compartment end cap main wall extending between the right compartment end cap side walls over the first panel surface of the case frame panel, and the left compartment end cap comprises a pair of spaced-apart left compartment end cap side walls extending from the second panel surface at the panel side edges, respectively, of the case frame panel, a left compartment end cap rear wall extending from the second panel surface at the right panel edge of the case frame panel and between the left compartment end cap side walls and a left compartment end cap main wall extending between the left compartment end cap side walls over the second panel surface of the case frame panel.

17. The contact lens package case of claim 16 further comprising a right cover securing mechanism carried by the right compartment end cap main wall of the right compartment end cap and the right compartment cover and a left cover securing mechanism carried by the left compartment end cap main wall of the left compartment end cap and the left compartment cover, and wherein the right cover securing mechanism secures the right compartment cover in the closed position and the left cover securing mechanism secures the left compartment cover in the closed position.

18. The contact lens package case of claim 17 wherein the right cover securing mechanism comprises a pair of right cover magnets and the left cover securing mechanism comprises a pair of left cover magnets.

* * * * *